United States Patent [19]

Hoffman et al.

[11] Patent Number: 4,517,103

[45] Date of Patent: May 14, 1985

[54] LUBRICATING COMPOSITIONS CONTAINING 5,5'-DITHIOBIS(1,3,4-THIADIAZOLE-2-THIOL)

[75] Inventors: David M. Hoffman, Weston; John J. Feher, Milford; Homer H. Farmer, Westport, all of Conn.

[73] Assignee: R. T. Vanderbilt Company, Inc., Norwalk, Conn.

[21] Appl. No.: 485,817

[22] Filed: Apr. 18, 1983

[51] Int. Cl.[3] ..... C10M 5/22

[52] U.S. Cl. ..... 252/28; 252/47

[58] Field of Search ..... 252/47, 28, 37.2, 40.7, 252/42.1

[56] References Cited

U.S. PATENT DOCUMENTS

| | | | |
|---|---|---|---|
| 2,719,125 | 9/1955 | Roberts | 252/47 X |
| 3,161,575 | 12/1964 | Wells et al. | 204/52 |
| 3,609,079 | 9/1971 | Devine et al. | 252/46.3 |
| 3,980,573 | 9/1976 | Okorodudu | 252/46.7 |
| 4,039,552 | 8/1977 | Brois et al. | 252/47 X |
| 4,097,387 | 6/1978 | Caspari | 252/47 |
| 4,107,059 | 8/1978 | King et al. | 252/28 |
| 4,308,182 | 12/1981 | Eckard et al. | 252/18 |

FOREIGN PATENT DOCUMENTS

| | | | |
|---|---|---|---|
| 966842 | 4/1975 | Canada | 260/308.3 |
| 943790 | 6/1956 | Fed. Rep. of Germany | 252/47 |

OTHER PUBLICATIONS

Boner, C. J., "Manufacture & Application of Lubricating Greases", 1954, pp. 225–227.

R. W. Watson, Application of Thiadiazoles as Mineral Oil Additives, p. 886, ÖGEW/DGMK Society's Meeting, Oct. 4 to 6, 1976, Salzburg, Germany.

*Primary Examiner*—Andrew H. Metz

*Attorney, Agent, or Firm*—Rasma B. Balodis

[57] ABSTRACT

Lubricating compositions having improved extreme pressure properties are disclosed. The compositions comprise a lubricating grease or a lubricating oil dispersion and an effective amount of 5,5'-dithiobis(1,3,4-thiadiazole-2-thiol).

4 Claims, No Drawings

LUBRICATING COMPOSITIONS CONTAINING 5,5'-DITHIOBIS(1,3,4-THIADIAZOLE-2-THIOL)

BACKGROUND OF THE INVENTION

The present invention concerns lubricating compositions and more particularly lubricating grease compositions having improved extreme pressure and other beneficial properties.

Many lubricants which are satisfactory under ordinary lubricating conditions do not provide adequate lubrication under the high frictional forces and temperatures that characterize extreme pressure conditions. Under these conditions friction gives rise to localized high temperatures at the metal surfaces. If this situation is not controlled, the metal parts in contact will seize or be scored causing failure of the parts.

Lubricating additives known as extreme pressure agents are employed to increase the load-carrying capacity of lubricants. The extreme pressure agents promote the formation of an antiweld film and thereby prevent welding of the contacting surfaces.

It is known in the art that certain sulfur containing compounds possess extreme pressure properties. However, many impart to the grease composition the undesirable properties of corrosion and staining of the metal surfaces in contact with the composition. Still others do not possess sufficient efficacy. The latter include polymers of 1,3,4-thiadiazole-2,5-dithiol which possess relatively low extreme pressure properties, insufficient for heavy duty applications when used as a sole extreme pressure agent as indicated in U.S. Pat. No. 4,308,182 granted Eckard et al Dec. 29, 1981.

Surprisingly, it has now been discovered that the dimer of 1,3,4-thiadiazole-2,5-dithiol imparts to lubricating grease composition good load carrying ability without causing the composition to corrode or discolor the metal surface to be protected.

SUMMARY OF THE INVENTION

The invention provides a lubricating composition comprising a major amount of lubricating grease or lubricating oil and a minor amount of 5,5'-dithiobis(1,3,4-thiadiazole-2-thiol). The minor amount is sufficient to impart extreme pressure properties to the composition.

Another aspect of the invention concerns a process for preparation of a novel lubricating composition by forming a mixture of lubricating base oil, thickener and grease forming additives and characterized by the improvement of adding to the mixture 0.1 to 10 percent 5,5'-dithiobis(1,3,4-thiadiazole-2-thiol), agitating and milling the mixture to a grease consistency. Optionally, the composition may contain other functional lubricating additives.

DESCRIPTION OF SPECIFIC EMBODIMENTS

The 5,5'-dithiobis(1,3,4-thiadiazole-2-thiol) compound may be prepared by known oxidation methods. Exemplary method of oxidizing 2,5-dimercapto-1,3,4-thiadiazole with iodine to yield the dimer is described in U.S. Pat. No. 3,161,575 granted Wells et al Dec. 15, 1964 and incorporated herein by reference.

The dimer compound of the present invention is of low volatility and substantially ashless in character. Both properties are desirable for lubricating applications under high load conditions.

The lubricating compositions contemplated for use herein include lubricating greases and lubricating oil dispersions.

Lubricating greases are well known in the art. The compositions are prepared by thickening a base oil of lubricating viscosity with a thickening agent. The base oil may be selected from oils derived from petroleum hydrocarbon and synthetic sources. The hydrocarbon base oil may be selected from naphthenic and paraffinic mineral oils. The synthetic oils may be selected from, among others, alkylene polymers, polysiloxanes, carboxylic acid esters and polyglycol ethers.

The thickeners may be selected from organic metal salts, metal complex salts, minerals and polymeric compounds. Exemplary thickeners include, among others, fatty soaps, carboxylic acid salts, mixed and complex salts of alkali metals, alkaline earth metals and aluminum. Other thickeners include polyurea, silica gel and modified clay minerals. Particularly preferred are tetrahydrocarbyl substituted quaternary ammonium bentonite and hectorite clays.

The amount of additive required to be effective for imparting extreme pressure characteristics in lubricating compositions may range from about 0.1 to 10 percent of the total lubricating composition. The preferred range is about 0.5 to about 5.0 percent of the extreme pressure agent of the total lubricating composition.

The extreme pressure additive of the invention may be added directly to the grease composition and dispersed therein by agitation and subsequent milling according to known techniques.

Alternately, the extreme pressure agent may be dispersed in base oil and then added to the grease composition. The compositions may include dispersing agents and detergents.

The lubricating oil dispersion containing the dimer possesses extreme pressure properties and may be used for certain lubricating applications without being formulated into a grease.

In addition to the extreme pressure property, the dimer displays antioxidant properties. The compound is compatible with metals. Lubricating compositions containing the dimer cause no corrosion or discoloration of metals in contact with same.

Depending upon the intended use of the lubricant, other functional additives may be added to enhance a particular property of the lubricant. The lubricating grease and oil dispersion may further contain known antioxidants, antiwear agents, metal passivators, rust inhibitors and other extreme pressure agents.

The following examples are given for the purpose of further illustrating the invention. All percentages and parts are based on weight unless otherwise indicated.

EXAMPLE 1

The dimer of the invention was formulated with various commercially available base greases and oil.

The extreme pressure characteristics of the formulations were evaluated by measuring the weld point of the grease formulations in a four-ball tester according to the ASTM D-2596-69 procedure and the oil formulation according to the ASTM D-2783-81 procedure. The results compiled in Table I show that all lubricating formulations containing the dimer yielded high weld load points indicating excellent extreme pressure characteristics.

EXAMPLE 2

Lithium 12-hydroxystearate grease was formulated with varying amounts of the dimer of the invention. The weld load points were measured by the procedure described in Example 1. The results compiled in Table II indicate that good weld load points were obtained over the entire experimental range. Optimum results were obtained with formulations containing greater than two parts dimer per hundred parts formulation.

EXAMPLE 3

Lithium 12-hydroxystearate grease was formulated with 3.0 percent dimer of the invention. The grease formulation 24 was tested for overall functional properties advantageous for general lubricating applications. Formulation 23 containing no extreme pressure agent was used as control.

Extreme pressure performance was evaluated by the Timken test according to ASTM D-2909 procedure.

The antioxidative efficacy was measured by the ASTM D-942 oxidation test. The compatibility of the dimer with respect to metals was demonstrated by the corrosion test at 100° C. according to ASTM D-130.

The test data are compiled in Table III. The grease composition prepared according to the invention showed good overall lubricating properties. Moreover, metals in contact with the grease showed no discoloration or corrosion as a result of addition of the dimer to the composition.

The above embodiments and illustrations have shown various aspects of the present invention. Other variations will be evident to those skilled in the art and such modifications are intended to be within the scope of the invention as defind by the appended claims.

TABLE I

| Formulation | Four-Ball Extreme Pressure Test: Dimer Parts, | Base Identity | Base Parts | Weld Point, Kg |
|---|---|---|---|---|
| 1 | — | Ca complex grease[1] | 100.0 | 400 |
| 2 | 3.0 | Ca complex grease | 97.0 | 800 |
| 3 | — | Bentone[2] grease[3] | 100.0 | 126 |
| 4 | 3.0 | Bentone grease | 97.0 | 315 |
| 5 | — | Al complex grease[4] | 100.0 | 160 |
| 6 | 3.0 | Al complex grease | 97.0 | 500 |
| 7 | — | Li complex grease[5] | 100.0 | 200 |
| 8 | 3.0 | Li complex grease | 97.0 | 800 |
| 9 | — | Li 12-hydroxystearate grease[5] | 100.0 | 160 |
| 10 | 3.0 | Li 12-hydroxystearate grease | 97.0 | 620 |
| 11 | — | Polyurea grease[6] | 100.0 | 100 |
| 12 | 3.0 | Polyurea grease | 97.0 | 315 |
| 13 | — | Oil dispersion[7] | 100.0 | 126 |
| 14 | 3.0 | Oil dispersion | 97.0 | 500 |

[1]Manufactured by Exxon Company
[2]Bentone TM 34 dimethyldihydrogenated tallow ammonium bentonite manufactured by NL Industries, Inc.
[3]Manufactured by Southwestern Petroleum Corporation
[4]Manufactured by Southwest Petro-Chem Division of Witco Chemical Co.
[5]Manufactured by Texaco Inc.
[6]Manufactured by Shell Oil Co.
[7]Clavus TM 220 oil manufactured by Shell Oil Co.

TABLE II

| Formulation | Four-Ball Extreme Pressure Test: Dimer, Parts | Li 12-hydroxystearate Grease, Parts | Weld Point, Kg |
|---|---|---|---|
| 15 | — | 100.00 | 160 |
| 16 | 0.25 | 99.75 | 200 |
| 17 | 0.50 | 99.50 | 250 |
| 18 | 1.00 | 99.00 | 315 |
| 19 | 2.00 | 98.00 | 500 |
| 20 | 3.00 | 97.00 | 500 |
| 21 | 4.00 | 96.00 | 500 |
| 22 | 5.00 | 95.00 | 620 |

TABLE III

Functional Properties of Lithium 12-hydroxystearate Grease

| Tests | Test Data: Base Formulation No. 23 | Formulation No. 24 |
|---|---|---|
| Timken pass load, kg | <7 | 22.7 |
| scar width, mm | — | 1.8 |
| Oxidation properties | | |
| Pressure drop, kPa | | |
| in 100 hours | >345 | 21 |
| in 300 hours | — | 41 |
| in 500 hours | — | 55 |
| Copper corrosion test rating | | |
| after 3 hours | 1b | 1b |
| after 24 hours | 1b | 1b |
| Steel strip corrosion test rating | | |
| rating after 3 hours | no discoloration | no discoloration |

What is claimed is:

1. A lubricating composition comprising a major amount of an oil of lubricating viscosity wherein said oil is a petroleum hydrocarbon oil or a synthetic oil and dispersed therein from about 0.1 to 10 percent of 5,5'-dithiobis(1,3,4-thiadiazole-2-thiol).

2. A process for preparation of a lubricating composition by forming a mixture of an oil of lubricating viscosity, thickener and grease forming additives, the improvement of which comprises the steps of:

(1) adding to the mixture from about 0.1 to 10 percent 5,5'-dithiobis(1,3,4-thiadiazole-2-thiol);

(2) agitating to a homogeneous mixture; and (3) milling to a grease consistency.

3. A lubricating grease composition comprising a major amount of an oil of lubricating viscosity wherein said oil is a petroleum hydrocarbon oil or a synthetic oil, a thickener in an amount effective to thicken the composition to a grease consistency, and from about 0.1 to 10 percent of 5,5'-dithiobis(1,3,4-thiadiazole-2-thiol).

4. A lubricating grease composition according to claim 3 wherein the thickener is selected from the group consisting of salts of fatty acids, complexes of fatty acids, mixtures of salts and complexes of fatty acids, polyurea compounds, quaternary ammonium bentonite and quaternary ammonium hectorite, wherein said salts and complexes are selected from the group consisting of lithium, aluminum, and calcium salts and complexes.

* * * * *